US006926470B2

(12) United States Patent
Taenaka et al.

(10) Patent No.: US 6,926,470 B2
(45) Date of Patent: Aug. 9, 2005

(54) METAL SHEET PILE

(75) Inventors: Shinji Taenaka, Futtsu (JP); Kenji Nishiumi, Futtsu (JP); Masataka Tatsuta, Chiyoda-ku (JP); Yousuke Miura, Futtsu (JP); Humitaka Maeda, Chiyoda-ku (JP); Kazuhiko Eda, Chiyoda-ku (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/673,491

(22) Filed: Sep. 30, 2003

(65) Prior Publication Data

US 2004/0093821 A1 May 20, 2004

(30) Foreign Application Priority Data

Nov. 15, 2002 (JP) ..... 2002-331760

(51) Int. Cl.[7] ..... E02D 5/08
(52) U.S. Cl. ..... 405/281; 405/276; 405/278
(58) Field of Search ..... 405/274–287

(56) References Cited

U.S. PATENT DOCUMENTS

| | | | | |
|---|---|---|---|---|
| 976,573 A | * | 11/1910 | Jones | 405/278 |
| 2,020,315 A | | 11/1935 | Hughes | |
| 2,556,298 A | * | 6/1951 | Schaack | 405/278 |
| 2,581,717 A | * | 1/1952 | Schaack | 405/278 |
| 6,443,664 B1 | | 9/2002 | Horan et al. | |

FOREIGN PATENT DOCUMENTS

| | | | |
|---|---|---|---|
| FR | 53493 E | | 1/1946 |
| JP | 37-23620 A | | 9/1962 |
| JP | 60-85326 U | | 6/1985 |
| JP | 2689794 B2 | | 12/1997 |
| JP | 10-71401 A | | 3/1998 |
| JP | 2964933 B2 | | 10/1999 |
| JP | 2000-192451 A | | 7/2000 |
| JP | 2000-192452 A | | 7/2000 |
| JP | 2001-248152 A | | 9/2001 |
| JP | 2002-201633 A | | 7/2002 |
| JP | 2002-522665 A | | 7/2002 |
| WO | WO 00/08263 A1 | | 2/2000 |

OTHER PUBLICATIONS

Ishiguro et al., "Ko–Yaita Ko–Ho" ("Method of construction using steel sheet pile"), vol. 1, pp. 34–36.

Ko–kan Kui Kyo–kai, "Ko–Yaita Sekkei kara sekou made" ("Steel Sheet Pile; Design and Construction") pp. 8–9.

* cited by examiner

*Primary Examiner*—Frederick L. Lagman
(74) *Attorney, Agent, or Firm*—Birch, Stewart, Kolasch & Birch, LLP

(57) ABSTRACT

A metal sheet pile has an improved joint strength and is suitable for high productivity manufacturing. Right and left end flanges are formed at opposite sides of the rolled steel sheet pile. Joints are formed at edges of the right and left end flanges. Cross-sections of the joints are point-symmetric or line-symmetric, wherein the end flange and the joint are disposed so that a center of point-symmetry of a pair of interfitted joints is located on or near a centerline of the end flange in the thickness direction. Furthermore, the joint has a protrusion for preventing rotation near the border between the joint and the end flange portion.

20 Claims, 7 Drawing Sheets

METAL SHEET PILE

CROSS-REFERENCE TO RELATED APPLICATIONS

This nonprovisional application claims priority under 35 U.S.C. §119(a) on Patent Application No. 2002-331760, filed in Japan on Nov. 15, 2002, the entirety of which is incorporated herein by reference.

BACKGROUND OF THE INVENTION

1. Field of the Invention

The present invention relates to a metal sheet pile used for earth-retaining structures, fundamental structures, bank protection structures or water cut-off walls in the civil engineering and construction fields. In particular, the present invention relates to a rolled steel sheet pile, which has a strong joint, enables high productivity, and avoids the occurrence of bending and/or warping. In addition, the metal sheet pile of the present invention provides the choice of interlocking in a plurality of ways by using a single kind of metal sheet pile.

2. Description of Related Art

There are two kinds of steel sheet piles, one of which is manufactured by cold-pressing a steel sheet. The other kind of steel sheet pile is referred to as rolled sheet pile, and is made by hot-rolling a slab. The rolled steel sheet pile is generally more than 6 mm in thickness, and is used for earth-retaining structures, fundamental structures, bank protection structures and water cut-off walls, where cross-sectional rigidity, mechanical strength and interlocking strength of the joint is required.

The rolled steel sheet pile according to the background art is usually classified into sheet pile types such as U-shaped steel sheet pile, Z-shaped steel sheet pile, hat-shaped sheet pile and straight web-type steel sheet pile. Hat-shaped sheet pile has an approximate shape similar to a U-shape, and has an end flange portion with a joint formed at an edge thereof. The end flange portion is parallel to a central flange portion of the hat-shaped sheet pile. The joints of steel sheet pile according to the background art are shaped, for example, as shown in FIG. 7(*a*), FIG. 7(*b*) and FIG. 7(*c*). A joint 10 shown in FIG. 7(*a*) is one of the most popular types of joint used for U-shaped steel sheet pile, because the joint is made by a relatively less amount of steel.

A joint 11 shown in FIG. 7(*b*) is typically employed for straight web-type steel sheet pile, which is used for cell-type structures, because the joint has a high strength. However, the joint of FIG. 7(*b*) is heavy and is inefficient with regard to steel consumption, since made of a relatively higher amount of steel.

A joint 12 shown in FIG. 7(*c*) is typically used for Z-shaped steel sheet pile or hat-shaped steel sheet pile, because one side of the joint portion can be flattened. However, the joint on each side of the sheet pile is asymmetric.

A rolled steel sheet pile is normally manufactured by rolling a rectangular solid slab. When the joints to be formed at both the right and left sides are different in shape and weight, the manufacturing is difficult and bending and/or warping can occur. Therefore the joint shown in FIG. 7(*c*) is inefficient in productivity.

Since a rolled steel sheet pile is typically used for earth-retaining structures, fundamental structures, bank protection structures and water cut-off walls in civil engineering and construction, the joint is required to be of high strength.

In the actual use of a steel sheet pile where one joint is fitted into a joint of another adjacent sheet pile, each joint is stressed because the adjacent sheet piles are forced away from each other. In view of this, the joint of a steel sheet pile is required to be strong enough to resist such a stressful force. The strength of each part of the joint is defined by a moment arm, which is calculated by multiplying a predetermined load by a distance from the respective part to a point of a load vector, and a thickness of the respective part. Since each joint shown in FIG. 7(*a*), FIG. 7(*b*) and FIG. 7(*c*) has a relatively long distance from the respective part, which is a point of stress concentration, to the point of the load vector, the strength of the joint must be increased by increasing the amount of steel used. In other words, the ratio of the strength to the amount of steel used must be increased substantially.

SUMMARY OF THE INVENTION

An object of the present invention is to provide a metal sheet pile where the above mentioned problems are overcome. Specifically, an object of the present invention is to provide a metal sheet pile having a joint with a high strength, and which is easy to manufacture, is capable of avoiding bending and/or warping during manufacturing and is capable of being interlocked in a plurality of ways using a single kind of sheet pile.

In order to accomplish this object, a rolled steel sheet pile of the present invention comprises end flanges formed at opposite ends of the rolled steel sheet pile; and joints formed at edges of each of the end flanges, wherein cross-sections of a pair of the joints at opposite ends thereof have the same shape or are line-symmetric, and the end flange and the joint are disposed so that a center of a point-symmetry of a pair of interfitted joints is located on or near a centerline of the end flange in a thickness direction.

When one joint of one sheet pile is interfitted with another joint of another sheet pile to interlock one sheet pile with another, the pair of joints is defined as a pair of interfitted joints or interlocked joints.

In addition, the joint has a protrusion for preventing rotation near the border between the joint and the end flange. A hat-shaped steel sheet pile or a Z-shaped steel sheet pile is preferably used as a steel sheet pile of the present invention. In the case of using a hat-shaped steel sheet pile, fitting grooves on opposite ends of the steel sheet pile for receiving an engaging portion of the joint of an adjacent sheet pile open in opposite directions so that the cross-section of the two joints are point symmetric. Contrary to this, in the case of using a Z-shaped steel sheet pile, the joints on opposite ends of the steel sheet pile are arranged so that the fitting grooves open in the same direction.

The joint for interlocking includes three portions, i.e., a connecting portion, a bottom portion and an engaging edge portion in the rolled steel sheet pile of the present invention. The three portions form a fitting groove with an approximately trapezoidal and tapered-off cross-section so that a steel sheet pile is interlocked with an adjacent steel sheet pile by fitting the engaging edge portion of one sheet pile into the fitting groove of another sheet pile. In other words, a pair of interfitted or interlocked joints is formed.

The rolled steel sheet pile of the present invention is easier to manufacture, since the joints formed at opposite ends of the steel sheet pile have the same cross-section or are line-symmetric. In the case of using a hat-shaped steel sheet pile, the fitting grooves of the joints on the opposite ends of the steel sheet pile open in opposite directions so that the cross-section of the joints are point-symmetric and in the case of using a Z-shaped steel sheet pile, the joints on opposite ends of the steel sheet pile are arranged so that the fitting grooves open in the same direction.

The above arrangements can increase the degree of freedom in selecting a combination of steel sheet piles, which enables a steel sheet pile wall to built having various cross-sectional performance.

As mentioned above, the joint strength of steel sheet pile is defined by a moment arm, which is calculated by multiplying a predetermined load by a distance from each part of the joint to a point of a load vector, and a thickness of the respective part.

In the rolled steel sheet pile of the present invention, the end flange and the joint are disposed so that a center of a point of symmetry of a pair of interfitted joints is located on or near the centerline of the end flange in the thickness direction. This configuration minimizes the distance from each part of the joint, where a bending moment/stress is concentrated, to a point of a load vector. This provides a high strength to the joint and therefore decreases an amount of steel that must be used to manufacture the joint.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1(*b*) is an enlarged view of the joint of FIG. 1(*a*);

FIG. 3(*b*) is an enlarged view of the joint of the rolled steel sheet pile of FIG. 3(*a*);

DETAILED DESCRIPTION OF THE PREFERRED EMBODIMENTS

Figure 1A:
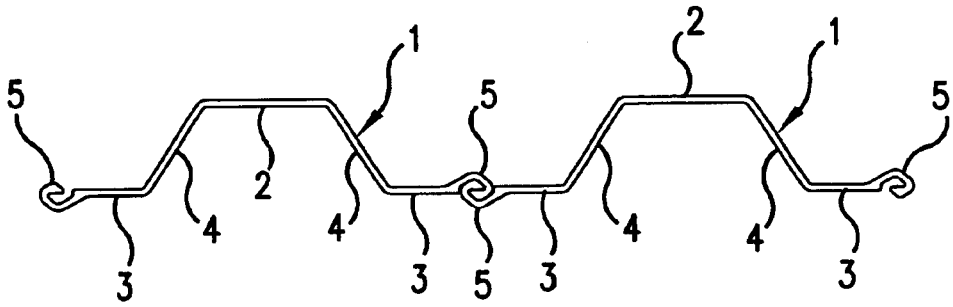
FIG. 1(*a*) is a plan view of a first embodiment of the present invention, which illustrates two hat-shaped steel sheet piles interlocked with each other by a joint.
Figure 1B:
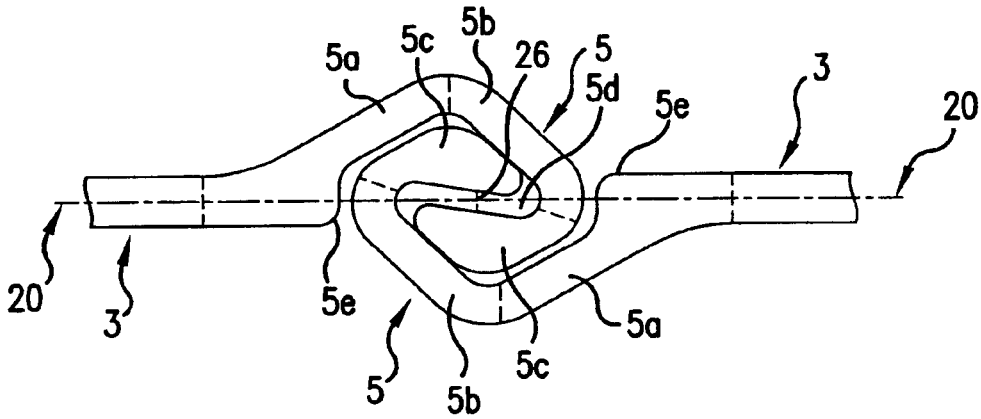

FIG. 1(*a*) is a plan view of a first embodiment of the present invention, which illustrates two hat-shaped steel sheet piles interlocked with each other by a joint. FIG. 1(*b*) is an enlarged view of the joint of FIG. 1(*a*) where a joint of one rolled steel sheet pile is fitted into a joint of an adjacent rolled steel sheet pile to form an interfitted or interlocked joint.

A rolled steel sheet pile 1 of the first embodiment has a hat-shaped cross section. The rolled steel sheet pile 1 includes a central flange 2, an end flange 3 and a web 4. The end flange 3 is generally parallel to the central flange 2. One end of a web 4 is connected to and extends from the central flange 2 at each opposite side end of the central flange 2. Each of the webs 4 is connected at an opposite end thereof to an end flange 3. A cross-section of the hat-shaped rolled steel sheet pile 1 is line-symmetric with respect to a central line perpendicular to the central flange at the center thereof except for the joints. Joints 5 are formed at ends of the end flanges 3 opposite to the webs 4. A right joint 5 and a left joint 5 have the same cross-section. However, fitting grooves of each of the right and left joints 5, 5, which receive a joint of an adjacent steel sheet pile, open in opposite directions so that the cross-section of the two joints is point-symmetric. A fitting groove 5*d* of one steel sheet pile 1 receives an engaging edge portion 5*c* of an adjacent steel sheet pile 1. At the same time, a fitting groove 5*d* of the adjacent steel sheet pile 1 is also fitted into by an engaging edge portion 5*c* of the one steel sheet pile 1. In view of this, adjacent steel sheet piles 1 are interlocked one after another so as to make a wall of steel sheet piles 1.

As shown in FIG. 1(*b*), each of the right or left joints 5 of the first embodiment of the present invention comprise a connecting portion 5*a*, a bottom portion 5*b* and an engaging edge portion 5*c* which form an approximately trapezoidal and tapered-off fitting groove 5*d* in cross-section. A protrusion 5*e* is formed on the fitting groove side of the connecting portion 5*a*, which prevents the joint 5 from rotation.

The above-mentioned rolled steel sheet pile 1 has two joints 5, 5 having the same cross-section located at both side ends thereof. Such a configuration enables a very stable manufacturing of the sheet pile, since the steel sheet being rolled can keep its symmetric shape in the width direction, until the terminal stage of the rolling process where the joint is to be formed by bending. This prevents the occurrence of bending and/or warping of the steel sheet.

As shown in FIG. 1(*b*), a pair of interfitted or interlocked joints is point-symmetric about a center of point-symmetry 26, which is positioned on or near the centerline 20 of the end flanges 3 in the thickness direction. This configuration is for minimizing the distance from each part of the joint 5 where a bending moment arm/stress is concentrated to a point of a load vector, so as to give a high strength to the joint 5.

Figure 2A:
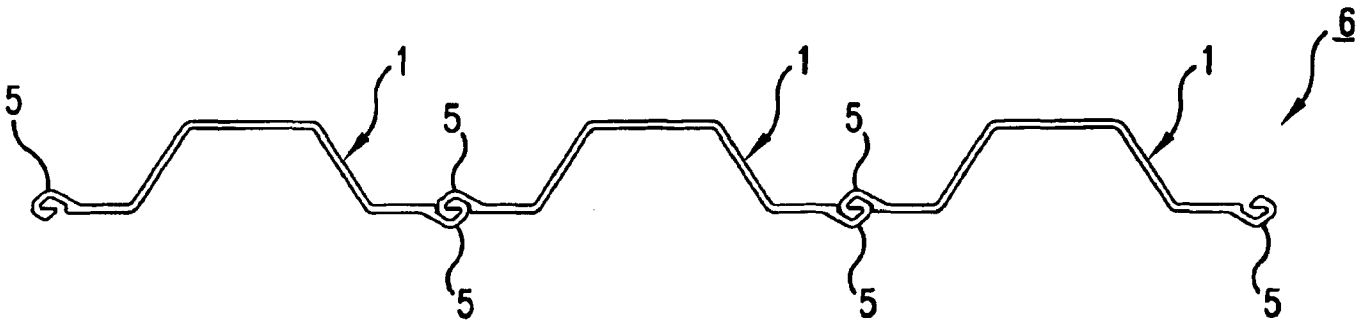
FIGS. 2(*a*) and 2(*b*) illustrate examples of the cross-section of steel sheet pile walls made by a combination of the hat-shaped rolled steel sheet piles of the first embodiment of the present invention.
Figure 2B:
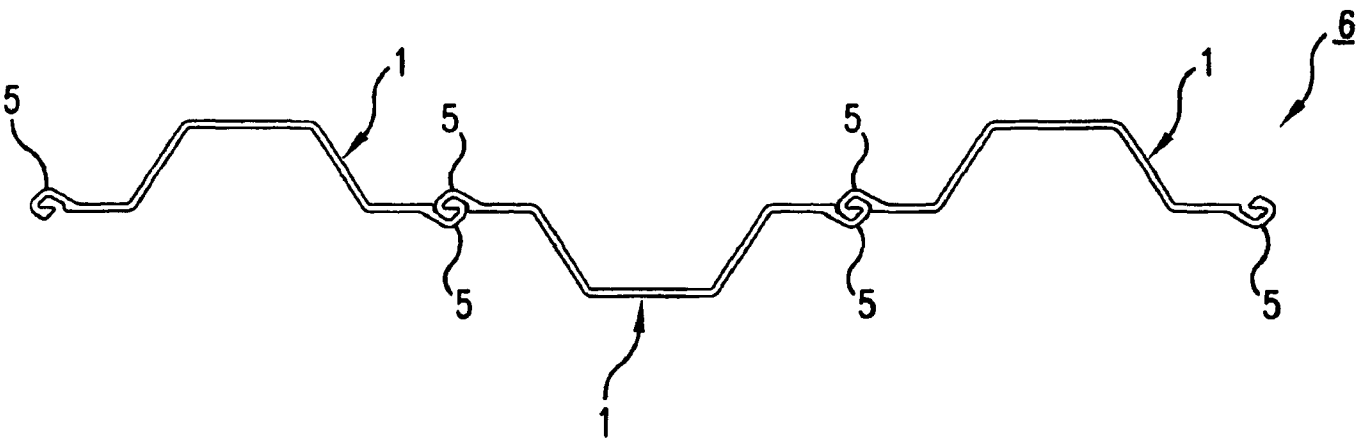

FIGS. 2(*a*) and 2(*b*) illustrate examples of the cross-section of a steel sheet pile wall made by a combination of the hat-shaped rolled steel sheet piles 1 of the first embodiment. The rolled steel sheet pile 1 has a pair of joints which are configured to be point-symmetric. Accordingly, it is possible to construct a steel sheet pile wall 6, as illustrated in FIG. 2(*b*), where the sheet piles are combined so as to be turned over alternatively. In addition, it is possible to construct a steel sheet pile wall 6, as illustrated in FIG. 2(*a*), where all the sheet piles are facing in the same direction. The steel sheet pile wall 6 illustrated in FIG. 2(*b*) has a better cross-sectional rigidity than that of the wall shown in FIG. 2(*a*), but requires a wider width to be built. Since two ways of interlocking the sheet piles 1 to form the steel sheet pile wall 6 is possible, a wall can be designed with various cross-sectional performance to meet the needs of a particular situation. It should also be noted that the steel sheet pile 1 of the present invention could also be interlocked with a combination of the arrangement illustrated in FIG. 2(*a*) and the arrangement illustrated in FIG. 2(*b*), depending on a particular application.

U-shaped steel sheet pile and hat-shaped steel sheet pile according to the background art do not have a pair of joints which is formed by the same two joints disposed in point-symmetry. This leads to only one way of combining steel sheet piles, where all of the sheet piles face in the same direction. Therefore a conventional type of steel sheet pile product provides only one wall cross-sectional performance. The rolled steel sheet pile 1 of the present invention can offer a steel sheet pile which enables a steel sheet pile wall 6 to be constructed with various wall cross-sectional performance without changing the type of steel sheet pile being used. For example, in the steel sheet pile wall 6 shown in FIG. 2(*b*), where the sheet piles are turned over alternatively, a better wall cross-section rigidity can be obtained ranging from up to 2.5 times that of a wall shown in FIG. 2(*a*). However, this arrangement may be limited by the conditions where the construction is occurring.

Figure 3A:
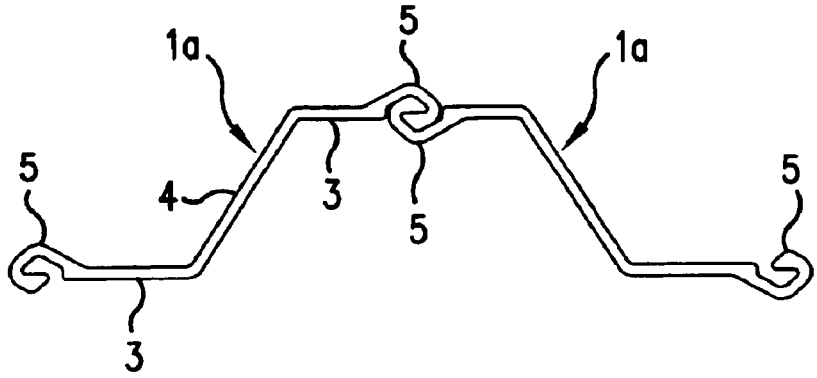
FIG. 3(*a*) is a plan view of a second embodiment of the present invention, which illustrates two Z-shaped rolled steel sheet piles interlocked with each other by a joint.
Figure 3B:
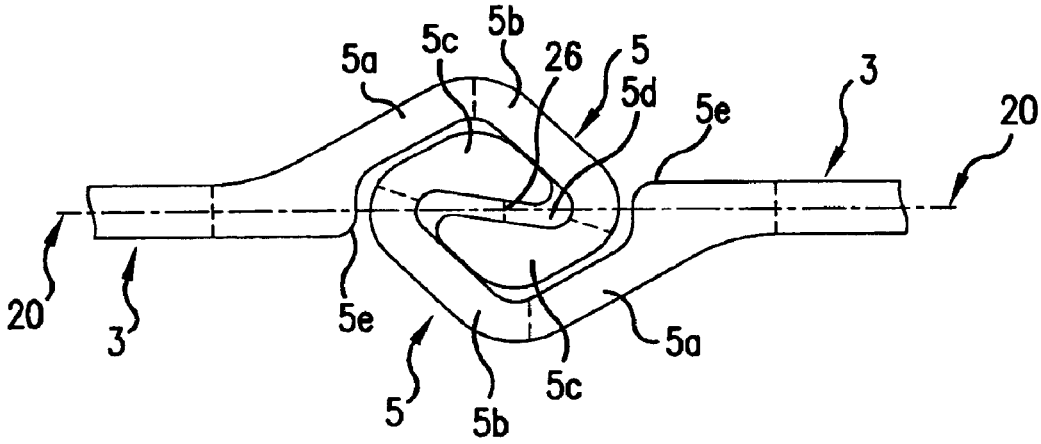

FIG. 3(*a*) is a plan view of a second embodiment of the present invention, which illustrates two Z-shaped rolled steel sheet piles interlocked with each other by a joint. FIG. 3(*b*) is an enlarged view of the joint of FIG. 3(*a*) where one joint is fitted into a joint of an adjacent rolled steel sheet pile. The joint shown in FIG. 3(*b*) of the second embodiment is the same as the joint shown in FIG. 1(*b*) of the first embodiment.

A Z-shaped rolled steel sheet pile la of the second embodiment includes a web 4, two end flanges 3, 3 connected to and extending from opposite ends of the web 4, and right and left joints 5, 5 formed at the edges of the end flanges, respectively.

In the Z-shaped rolled steel sheet pile 1*a*, the two end flanges 3 are parallel and the entire cross-sectional view is point-symmetric, except for the joint. The right and left joints are arranged so that two fitting grooves open in the same direction and the cross-section of the two joints are line-symmetric.

Figure 4A:
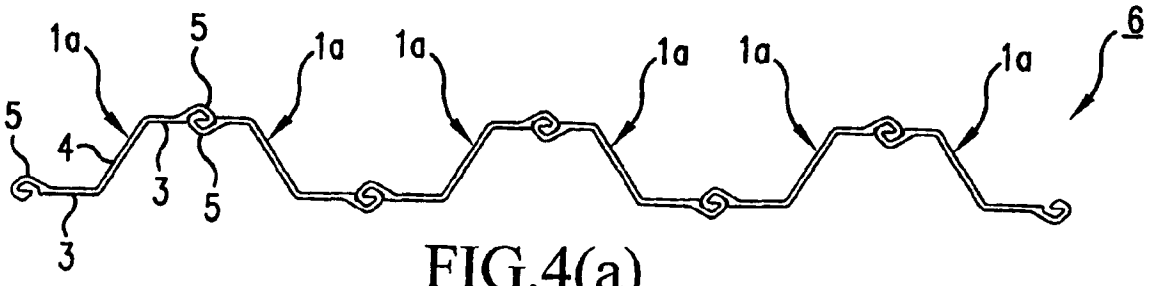
FIGS. 4(*a*), 4(*b*) and 4(*c*) illustrate examples of the cross-section of a steel sheet pile wall made by a combination of the Z-shaped rolled steel sheet piles of the second embodiment of the present invention.
Figure 4B:
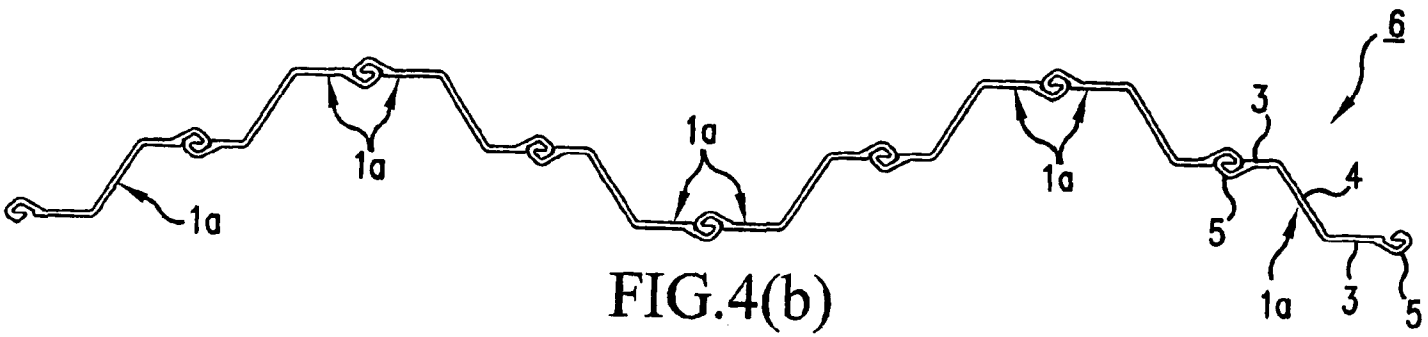
Figure 4C:
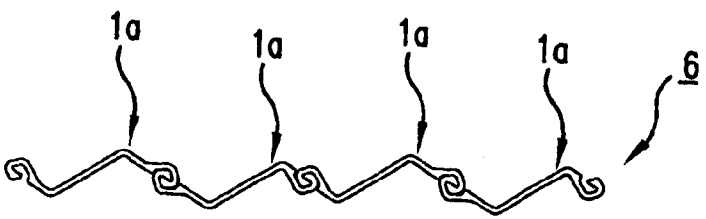

FIGS. 4(*a*), 4(*b*) and 4(*c*) illustrate examples of a cross-sections of steel sheet pile walls 6 made by a combination of the Z-shaped rolled steel sheet piles 1*a* to which the joint of the present invention is applied. The Z-shaped rolled steel sheet piles 1*a* enable the construction of a steel sheet pile wall 6 with various cross-section performance by selecting the way of interlocking adjacent steel sheet piles 1*a*. For example, FIG. 4(*a*) illustrates a steel sheet pile wall 6 where the steel sheet piles 1*a* are combined so as to be turned over alternatively, FIG. 4(*b*) illustrates a steel sheet pile wall 6 where a pair of steel sheet piles 1*a* are interlocked so that the pair is turned over alternatively, and FIG. 4(*c*) illustrates a steel sheet pile wall 6 where all the sheet piles are facing in the same direction to limit the height of the cross-section as much as possible.

A steel sheet pile wall 6 other than the one illustrated in FIG. 4(*a*) can provide a wall cross-sectional rigidity ranging from 0.2 to 2.5 times that of the wall shown in FIG. 4(*a*).

Figure 5A:
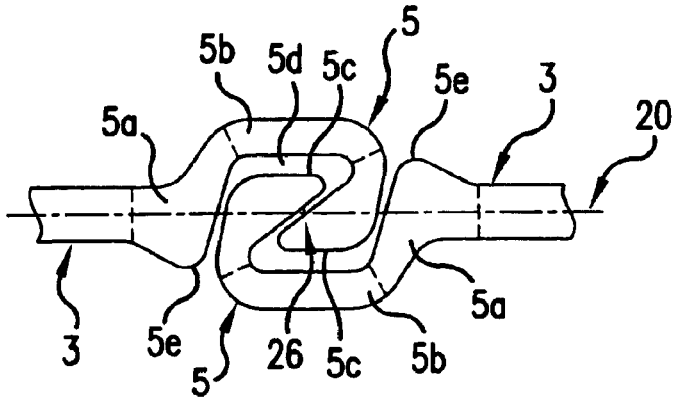
FIGS. 5(*a*), 5(*b*) and 5(*c*) illustrate examples of joints of a rolled steel sheet pile of the present invention.
Figure 5B:
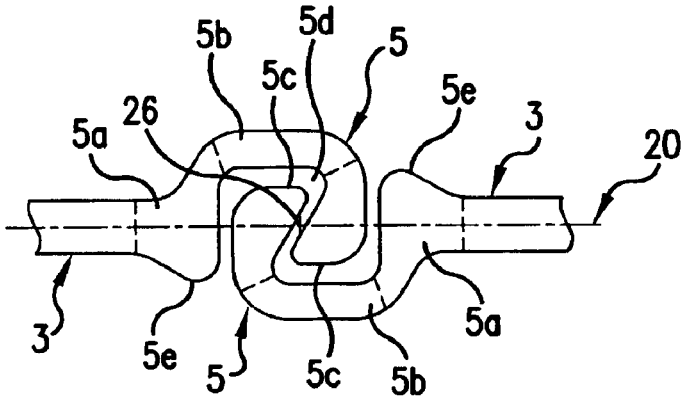
Figure 5C:
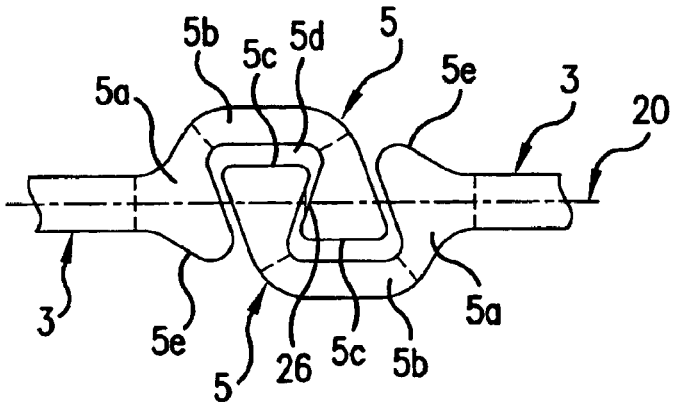
Figure 6A:
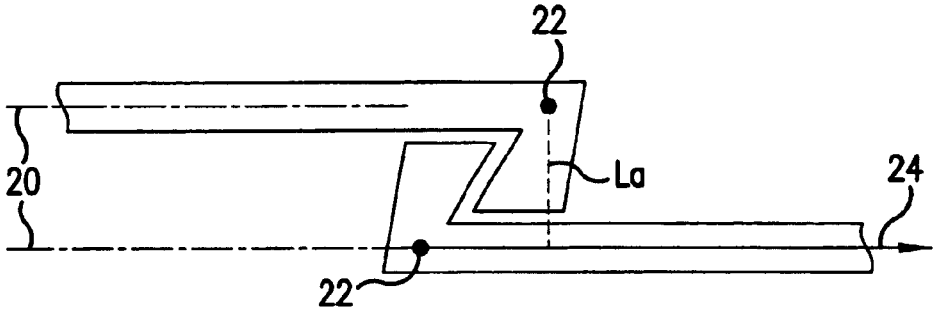
FIGS. 6(*a*), 6(*b*), 6(*c*) and 6(*d*) are explanatory views illustrating how a moment arm can be decreased to increase the strength of a joint of the steel sheet piles of the present invention.
Figure 6B:
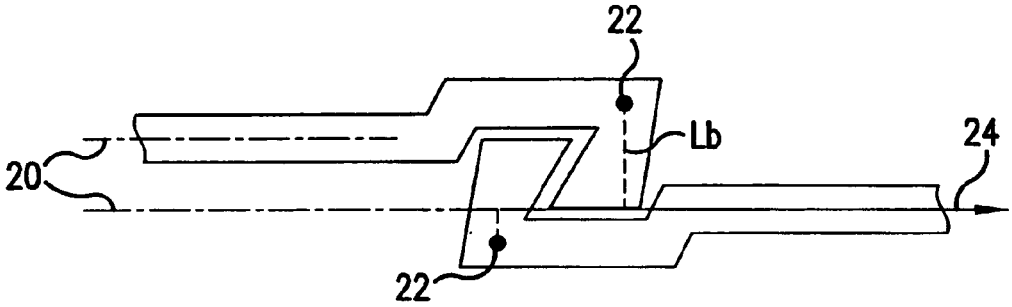
Figure 6C:
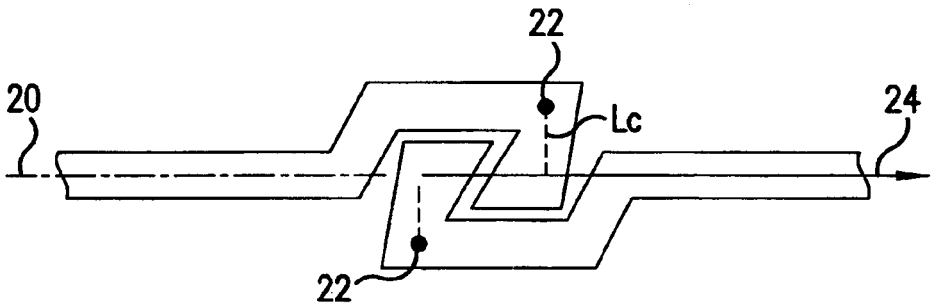
Figure 6D:
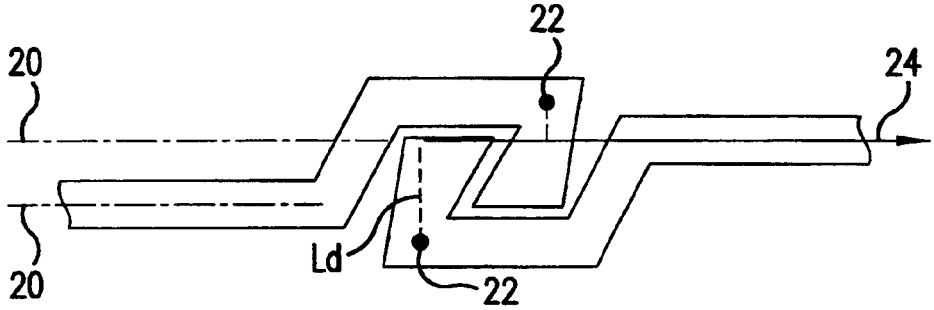

FIGS. 5(*a*), 5(*b*) and 5(*c*) illustrate examples of joints of a rolled steel sheet pile of the present invention. The joint 5 in all examples includes a connecting portion 5*a*, a bottom portion 5*b* and an engaging edge portion 5*c*, which form an approximately trapezoidal and tapered-off fitting groove 5*d*. A protrusion 5*e* is formed on the fitting groove side of the connecting portion 5*a*, which is for preventing the joint from rotation.

Figure 7A:
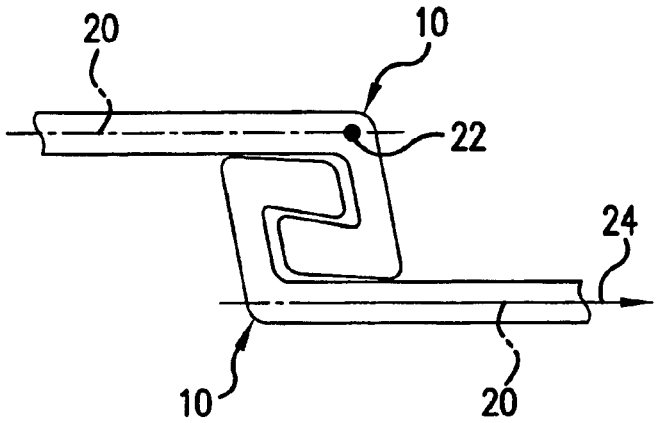
FIG.7(a) BACKGROUND ART
FIGS. 7(*a*), 7(*b*) and 7(*c*) illustrate examples of joints of steel sheet pile according to the background art.
Figure 7B:
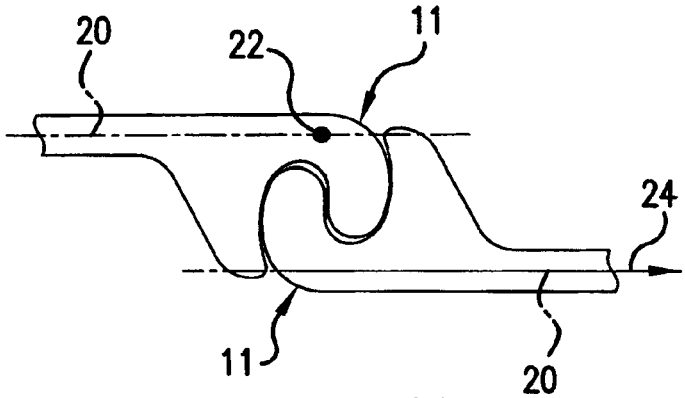
FIG.7(b) BACKGROUND ART
Figure 7C:
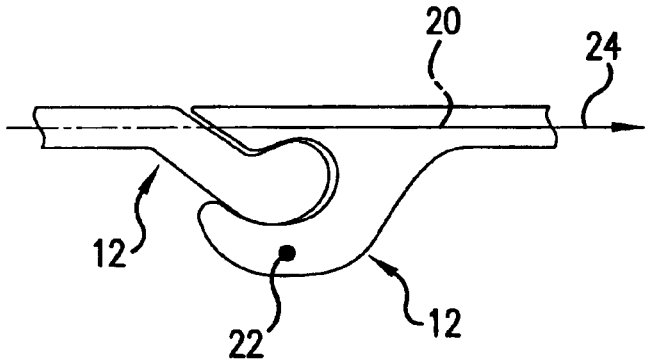
FIG.7(c) BACKGROUND ART

A joint of the steel sheet pile is formed by bending at the terminal stage of the rolling process by using rolls for nipping and applying pressure from the outside to the edge portion of the steel plate, which has been formed by rolling at a previous stage. In view of this, a shorter joint length (summation of the lengths of the connecting portion, the bottom portion and the engaging edge portion) provides a higher manufacturing productivity. FIG. 5(*b*) illustrates a modified example of a joint in FIG. 5(*a*), where a joint fitting angle, i.e., the direction of the engaging edge portion, is changed to be more vertical for minimizing an amount of steel that must be used in the manufacture of the steel sheet pile. FIG. 5(*c*) illustrates another modified example for reducing the weight and increasing the strength of the joint. The joint of FIG. 5(*c*) has a protrusion 5*e* instead of one pawl of the background art joint shown in FIG. 7(*b*), which enables rolling accuracy to be less strict.

The rolled steel sheet pile of the present invention has a pair of right and left joints, one of which is point symmetric or line-symmetric with the other one in cross-section. In other words, the joints 5 on the opposite ends of the rolled steel sheet pile have the same shape in cross-section; however, the joints either open in the same direction or in opposite directions.

When a plurality of rolled steel sheet piles of the present invention is interlocked, a joint of one sheet pile is interfitted with a joint of an adjacent sheet pile to form a pair of interfitted or interlocked joints, which are point-symmetric in cross-sectional shape. The rolled steel sheet pile of the present invention has a pair of joints, which is arranged so that the center of a point of symmetry of the pair of interfitted joints is positioned on or near the centerline 20 of the end flanges 3 in the thickness direction. This configuration is for minimizing the distance from each part of the joint where a bending moment arm/stress is concentrated to a point of a load vector so as to provide a high strength joint. In addition, the steel sheet pile of the present invention keeps its symmetric shape in the width direction while being rolled until the terminal stage of the rolling process where the joint portion is to be formed by bending. This serves to prevent the occurrence of bending and/or warping of the steel sheet and leads to a very stable manufacturing of the steel sheet pile. The rolled steel sheet pile of the present invention is interlocked by using joints with the same shaped cross-section, which results in an increase in the degree of freedom of selecting a combination of steel sheet piles. This enables a steel sheet pile wall to be built with various cross-sectional performance, while a conventional steel sheet pile product can provide only one wall cross-sectional performance.

The rolled steel sheet pile of the present invention has a pair of joints, which are arranged so that the center of the point of symmetry of the pair of interfitted joints is positioned on or near the centerline 20 of the end flange in the thickness direction. The reason why this configuration can minimize the distance from each part of the joint where a bending moment arm/stress is concentrated to a point of a load vector will now be explained with reference to FIGS. 6(*a*), 6(*b*), 6(*c*) and 6(*d*). It should be noted that FIGS. 6(*a*)–6(*d*) are only for explanation purposes. Accordingly, other elements of the present invention such as the rotation preventing protrusion formed near the border between the joint portion and the end flange portion are not illustrated.

FIGS. 6(*a*) and 6(*b*) illustrate joints which have an engaging edge portion with the same cross-sectional shape, but are connected to respective end flanges in different connecting positions. A broken line 20 represents a centerline of the end flange in thickness direction, a point 22 represents a fracture point, i.e., a part of the joint where the stress is concentrated, an arrow 24 identifies a load vector, and L(a) and L(b) identify the distance between the fracture point and the load vector.

FIG. 6(*c*) illustrates a pair of joints, which are arranged so that the center of a point of symmetry of the pair of interfitted joints is positioned on or near the centerline 20 of the end flange in the thickness direction, according to an embodiment of the present invention. The distance Lc is the shortest compared to La in FIG. 6(*a*), Lb in FIG. 6(*b*) and Ld in FIG. 6(*d*).

When adjacent steel sheet piles are interlocked to form a pair of interfitted or interlocked joints, parts of each joint are stressed from the force of the adjacent sheet piles being pulled away from each other. In order to increase the strength of the joint against stress, it is recommended to design the joint so as to minimize a moment arm, which can be realized by the configuration where the pair of joints are designed so that the center of the point of symmetry of the pair of interfitted joints is positioned on or near the centerline 20 of the end flange in the thickness direction. FIG. 6(*c*) illustrates the smallest moment arm, and is therefore the preferred design. In this particular arrangement, it should also be noted that the end flanges connected to the pair of interfitted joints are generally co-axial.

It should be noted that throughout the present specification, rolled steel sheet pile has been discussed. However, the present invention is not limited to rolled steel sheet pile. Other metal sheet pile is also included within the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rolled steel sheet pile, comprising:

a first end flange;

a second end flange;

a first joint formed at an edge of said first end flange; and a second joint formed at an edge of said second end flange, each of said first and second joints including a connecting portion, a bottom portion, and an engaging edge portion, the connecting portion, the bottom portion and the engaging edge portion forming a fitting groove, a protrusion being formed on a fitting groove side of the connecting portion, and the engaging edge portion is for being received into a fitting groove of an adjacent rolled sheet pile to form a pair of interfitted joints, wherein a cross-sectional shape of said first and second joints is line-symmetric or point-symmetric, said first and second joints are designed so that a center of a point of symmetry of the pair of interfitted joints is located on or near a centerline of said first and second end flanges, respectively, in a thickness direction, and said first and second joints are designed so that a contact surface formed between the engaging edge portions of the pair of interfitted joints is a line contact and an axis of the line contact inclines toward the protrusions of the pair of interfitted joints.

2. The rolled steel sheet pile according to claim 1, wherein a cross-section of the engaging edge portion widens toward an end thereof.

3. The rolled steel sheet pile according to claim 1, wherein the fitting grooves of said first and second joints open in opposite directions, said first and second joints are located so that the cross-sections are point-symmetric, said first and second end flanges are connected to first and second webs, respectively, and the first and second webs are connected to each other via a central flange located therebetween.

4. The rolled steel sheet pile according to claim 1, wherein the fitting grooves of said first and second joints open in the same direction, said first and second end flanges are approximately parallel and are connected via a web which is non-parallel to said first and second end flanges.

5. The rolled steel sheet pile according to claim 1, wherein said rolled steel sheet pile is hat-shaped in cross-section and includes a central flange and first and second webs, said first web extending between and connecting one end of said central flange to said first end flange and said second web extending between and connecting an opposite end of said central flange to said second end flange.

6. The rolled steel sheet pile according to claim 1, wherein said rolled steel sheet pile is Z-shaped in cross-section and includes a web, one end of said web is connected to said first end flange and an opposite end of said web is connected to said second end flange.

7. The rolled steel sheet pile according to claim 1, wherein a centerline of each of said first and second end flanges is generally co-axial with respective end flanges of adjacent rolled steel sheet piles when said rolled steel sheet pile is engaged with the adjacent rolled steel sheet piles to form pairs of interfitted joints.

8. The rolled steel sheet pile according to claim 1, wherein the fitting grooves of said first and second joints open in opposite directions.

9. The rolled steel sheet pile according to claim 1, wherein said first and second end flanges are connected to first and second webs, respectively, the first and second webs are connected to each other via a central flange located therebetween.

10. A metal sheet pile, comprising:

first and second end flanges; and first and second joints formed at an edge of said first and second end flanges, respectively, each of said first and second joints including a fitting groove formed therein, and a protrusion extending into the fitting groove, wherein a cross-sectional shape of said first and second joints is line-symmetric or point-symmetric, said first and second joints are designed so that a center of a point of symmetry is located on or near a centerline of said first and second end flanges, respectively, in a thickness direction when the metal sheet pile is engaged with an adjacent metal sheet pile to form a pair of interfitted joints, and said first and second joints are designed so that a contact surface formed between the pair of interfitted joints is a line contact and an axis of the line contact inclines toward the protrusions of the pair of interfitted joints.

11. The metal sheet pile according to claim 10, wherein each of said first and second joints includes a connecting portion, a bottom portion, and an engaging edge portion, the connecting portion, the bottom portion and the engaging edge portion forming said fitting groove, and said protrusion is formed on a fitting groove side of the connecting portion.

12. The metal sheet pile according to claim 10, wherein a cross-section of the engaging edge portion widens toward an end thereof.

13. The metal sheet pile according to claim 10, wherein the fitting grooves of said first and second joints open in opposite directions, said first and second joints are located so that the cross-sections are point-symmetric, said first and second end flanges are connected to first and second webs, respectively, and the first and second webs are connected to each other via a central flange located therebetween.

14. The metal sheet pile according to claim 10, wherein the fitting grooves of said first and second joints open in the same direction, said first and second end flanges are approximately parallel and are connected via a web which is non-parallel to said first and second end flanges.

15. The metal sheet pile according to claim 10, wherein said metal sheet pile is hat-shaped in cross-section and includes a central flange and first and second webs, said first web extending between and connecting one end of said central flange to said first end flange and said second web extending between and connecting an opposite end of said central flange to said second end flange.

16. The metal sheet pile according to claim 10, wherein said metal sheet pile is Z-shaped in cross-section and includes a web, one end of said web is connected to said first end flange and an opposite end of said web is connected to said second end flange.

17. The metal sheet pile according to claim 10, wherein a centerline of each of said first and second end flanges is generally co-axial with respective end flanges of adjacent metal sheet piles when said metal sheet pile is engaged with the adjacent metal sheet piles to form pairs of interfitted joints.

18. The metal sheet pile according to claim 10, wherein the fitting grooves of said first and second joints open in opposite directions.

19. The metal sheet pile according to claim 10, wherein said first and second end flanges are connected to first and second webs, respectively, the first and second webs are connected to each other via a central flange located therebetween.

20. A rolled steel sheet pile, comprising:

a first end flange and a second end flange, said first and second end flanges being connected to first and second webs, respectively, and the first and second webs are connected to each other via a central flange located therebetween;

a first joint formed at an edge of said first end flange; and a second joint formed at an edge of said second end flange, each of said first and second joints including a connecting portion, a bottom portion, and an engaging edge portion, the connecting portion, the bottom portion and the engaging edge portion forming a fitting groove, a protrusion being formed on a fitting groove side of the connecting portion, and the engaging edge portion is for being received into a fitting groove of an adjacent rolled sheet pile to form a pair of interfitted joints, wherein a cross-sectional shape of said first and second joints is point-symmetric, said first and second joints are designed so that a center of a point of symmetry of the pair of interfitted joints is located on or near a centerline of said first and second end flanges, respectively, in a thickness direction, and the fitting grooves of said first and second joints open in opposite directions.

* * * * *